US006935433B2

(12) United States Patent
Gupta

(10) Patent No.: US 6,935,433 B2
(45) Date of Patent: Aug. 30, 2005

(54) HELIUM GAS TOTAL FLOOD FIRE SUPPRESSION SYSTEM

(75) Inventor: Alankar Gupta, Seattle, WA (US)

(73) Assignee: The Boeing Company, Chicago, IL (US)

( * ) Notice: Subject to any disclaimer, the term of this patent is extended or adjusted under 35 U.S.C. 154(b) by 176 days.

(21) Appl. No.: 10/209,690

(22) Filed: Jul. 31, 2002

(65) Prior Publication Data

US 2004/0020665 A1 Feb. 5, 2004

(51) Int. Cl.[7] ..... A62C 2/00; A62C 3/00; A62C 35/00; A62C 35/02; A62C 3/07

(52) U.S. Cl. ..... 169/46; 169/11; 169/16; 169/26; 169/62

(58) Field of Search ..... 169/46, 11, 16, 169/26, 62, 5, 9, 54, 56, 60, 61, 65, 66, 68; 239/67, 68, 303, 304; 137/68.13, 81.2

(56) References Cited

U.S. PATENT DOCUMENTS 2,537,074 A * 1/1951 Mapes ..... 169/11
4,226,728 A 10/1980 Kung
4,351,394 A 9/1982 Enk (Continued)

FOREIGN PATENT DOCUMENTS

EP 0878212 5/1998
EP 0951923 12/1998

OTHER PUBLICATIONS

Artim, "Cultural Heritage Fire Suppression Systems: Alternatives to Halon 1301," WACC Newsletter, May 19, 1993, pp. 34–36, vol. 15, No. 2.

Grosshandler, "Assessing Halon Alternatives for Aircraft Engine Nacelle Fire Supression," Journal of Heat Transfer, May 1995, pp. 489–494, vol. 117

Grabow, "Firedetex", New Fire/Smoke Detection and Fire Extinguishing Systems for Aircraft Applications, EADS Airbus GmbH, Presentation at ISAFPWG 2001, pp. 1–18, Long Beach, Mar. 2001.

*Primary Examiner*—David A. Scherbel
*Assistant Examiner*—Darren Gorman
(74) *Attorney, Agent, or Firm*—Robert R. Richardson

(57) ABSTRACT

The invention provides systems and methods adaptable to all gaseous agents including Helium to suppress fire in at least one enclosed space. Suppressants are delivered by a dedicated subsystem connected to cargo compartments or to engine nacelles, or by an integrated system connected to cargo compartments and engine nacelles. For example, at least a first reservoir stores fire suppressant composition for knocking down a fire in an enclosed space. Piping delivers the composition from the at least first reservoir to the enclosed space. A pressure sensor senses pressure of the composition in the piping, and a controllable purging device permits air to exit the enclosed space responsive to sensed pressure in the piping of the composition.

28 Claims, 5 Drawing Sheets

U.S. PATENT DOCUMENTS 4,552,325 A 11/1985 Bruensicke
4,606,832 A 8/1986 Hisamoto et al.
4,625,808 A 12/1986 Halfpenny
4,643,260 A 2/1987 Miller
4,646,848 A 3/1987 Bruensicke
4,646,993 A 3/1987 Baetke
4,726,426 A 2/1988 Miller
4,756,839 A 7/1988 Curzon et al.
4,826,610 A 5/1989 Thacker
4,953,623 A 9/1990 Applegate
4,954,271 A 9/1990 Green
5,102,557 A 4/1992 Nimitz et al.
5,135,054 A 8/1992 Nimitz et al.
5,183,116 A 2/1993 Fleming
5,211,246 A 5/1993 Miller et al.
5,287,702 A 2/1994 Blackshaw et al.
5,314,682 A 5/1994 Sweval et al.
5,346,669 A 9/1994 Sweval et al.
5,423,384 A 6/1995 Galbraith et al.
5,449,041 A 9/1995 Galbraith
5,573,067 A 11/1996 Fiterson
5,588,493 A 12/1996 Spector et al.
5,609,210 A 3/1997 Galbraith et al.
5,613,562 A 3/1997 Galbraith et al.
5,632,338 A 5/1997 Hunter
5,716,549 A 2/1998 Nimitz et al.
5,727,635 A 3/1998 Doty et al.
5,759,430 A 6/1998 Tapscott et al.
5,845,714 A 12/1998 Sundholm
5,899,275 A 5/1999 Okamoto et al.
5,918,680 A 7/1999 Maranghides
6,003,608 A 12/1999 Cunningham
6,082,464 A 7/2000 Mitchell et al.
6,601,653 B2 * 8/2003 Grabow et al. ..... 169/16

* cited by examiner

HELIUM GAS TOTAL FLOOD FIRE SUPPRESSION SYSTEM

FIELD OF THE INVENTION

This invention relates generally to fire suppression systems, and, more specifically to total flood fire suppression systems on board airplanes.

BACKGROUND OF THE INVENTION

Onboard aircraft fire suppression systems for fires occurring in cargo compartments and engines require fire suppressants (or fire suppression agents) that are non-corrosive, volatile, electrically non-conductive, compatible with aircraft materials, have a low freezing temperature, and are non-toxic at fire suppressant concentrations. Fire suppression systems are designed to reduce the intensity of fires to a non-hazardous state.

Depending on a particular fire and the fire's environment, fire suppressants, under certain conditions, may extinguish a fire by eliminating or disabling the combustion process. A fire suppression system in an aircraft generally first knocks down a fire, and then maintains the fire suppressed for a time period sufficient for the aircraft to safely land at the nearest airport. This time period can be lengthy for certain aircraft missions, such as over-water flights.

Presently, halogenated derivatives of methane gas, such as Bromochlorodifluoromethane ($CBrClF_2$, commonly known as Halon 1211) and Bromotrifluoromethane ($CF_3Br$, commonly known as Halon 1301), have been found to exhibit desired fire-suppressant properties. Further, relatively small volumes of Halon 1211 or Halon 1301 are required to be delivered to a compartment to extinguish a fire in the compartment. Halon 1211 is commonly used as a Streaming agent in portable (hand-held) fire extinguishers and Halon 1301 in total flood fire suppression systems.

However, halogenated methane derivatives are deleterious to the environment. Halon 1301, for example, has long atmospheric life and slowly migrates to the stratosphere where it catalytically destroys ozone. Under international agreement known as the Montreal Protocol, Halon production ceased in developed countries on Jan. 1, 1994. Existing supplies of Halon are used in commercial aircraft under renewable "critical use exemption" granted by the regulatory agencies of governments that are signatories to the Montreal Protocol.

As a result, efforts have been made to find replacement fire suppressants as effective as Halon 1301 and Halon 1211 that are environmentally safe and that can be used with a low-weight penalty. Fire suppressants examined include halogenated hydrocarbons (commonly known as halocarbons), water-mist, inert gases and aerosols. Methods evaluated include use of a single suppressant and the use of two different agents, sequentially, to suppress fire in the cargo compartment. However, in general, the overall weight penalty can be high and the system may be complicated compared to present Halon 1301 systems. In addition, some methods may generate high concentrations of corrosive and toxic chemicals.

Some of the inert gas agent is lost to the outside during constant pressure flooding of an enclosed space in "free efflux" total flooding systems. Generally, volumes of inert gas agents required are relatively larger than the volumes of Halon 1301 to extinguish a fire. As a result, use of agents other than Halon 1301 in currently known aircraft fire suppression systems could introduce into a compartment volumes of the agent that are sufficient to over pressurize the compartment. This could result in damage of the compartment walls and loss of compartment integrity essential for operation of the total flood system.

Thus, there is an unmet need to knock down and suppress fire occurring in an enclosed space using a lower-weight suppression system that complies with regulatory requirements, is friendly to the environment, and does not pose a threat to compartment integrity.

SUMMARY OF THE INVENTION

The invention includes systems and methods to suppress a fire in at least one enclosed space. The systems and methods of the invention are adaptable to all gaseous agents. In one presently preferred embodiment of the invention, Helium or Helium gas compositions are used as suppressants. Suppressants are delivered by a dedicated subsystem connected to cargo compartments or to engine nacelles. In another embodiment of the invention, the suppressants are delivered by an integrated system connected to cargo compartments and engine nacelles.

In one non-limiting embodiment, the Helium compositions are stored in a dual-reservoir apparatus having a first bottle and a second bottle. The Helium compositions are delivered from the first and second bottle to the enclosure containing the fire via delivery assemblies attached to the dual-reservoir apparatus. The Helium compositions are rapidly delivered from the first bottle to the enclosure to rapidly reduce the Oxygen concentration of compartment air, using free efflux flooding method, to generally accepted fire-suppressing Oxygen level. The rate of delivery of the knockdown Helium compositions is determined by the pressure-flow characteristics of the delivery system connecting the reservoirs to the enclosure. The rate of delivery is higher from the first bottle than the second bottle in order to rapidly lower ambient Oxygen concentrations to a reduced level that suppresses or knocks down the fire in a cargo compartment. Thereafter, after a designed time delay, the Helium compositions are delivered to the cargo compartment at a significantly lower rate from the second bottle to maintain the reduced Oxygen concentration in the enclosure for extended time to keep the fire suppressed. The second bottle is used in the engine nacelle only if the fire re-ignites or the first bottle discharge fails to adequately suppress the fire. The second bottle discharge, in the case of an engine nacelle fire, is as rapid as the first bottle discharge.

BRIEF DESCRIPTION OF THE DRAWINGS

The preferred and alternative embodiments of the present invention are described in detail below with reference to the following drawings.

DETAILED DESCRIPTION OF THE INVENTION

Figure 1A:
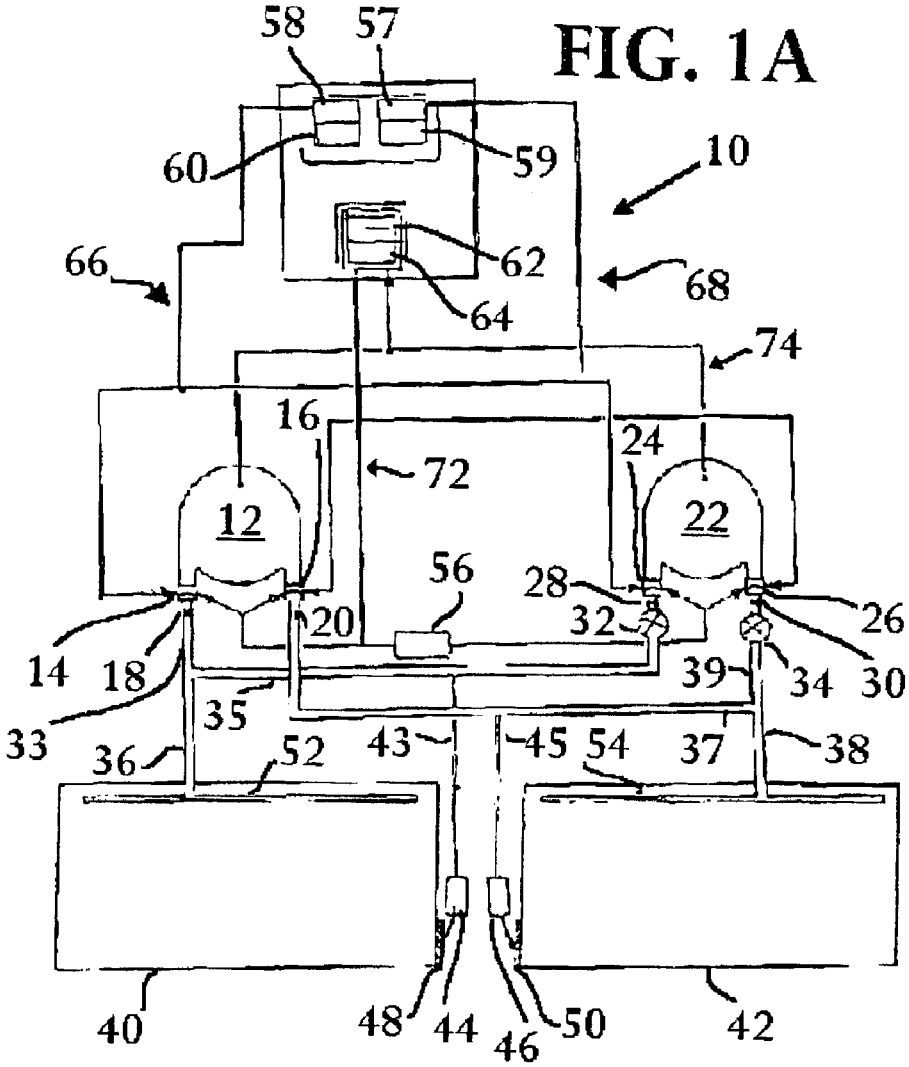
FIG. 1A is a schematic diagram of a Helium gas total flood fire suppression system for airplane cargo compartments.

The present invention is a total flood fire suppression system. One present embodiment of the invention uses Helium gas or Helium blended with other inert gases as a fire suppressant. Non-limiting embodiments of the invention will be described below for use in airplane engine compartments, airplane cargo compartments, and airplane cargo and engine compartments.

One present embodiment of the invention uses Helium because Helium has a better mass efficiency in knocking down and keeping fires suppressed than does Halon 1301. As shown in Table 1 below, less Helium mass is needed to maintain a fire suppressed in a space with a given leakage rate.

TABLE 1

Mass of Halon 1301 and Helium Required To Maintain An Atmosphere That Keeps A Fire Suppressed

| Compartment leakage rate (cfm) | Mass of Halon 1301 required to maintain 3% concentration in the enclosure (lb/hour of flight) See Notes 1, 2 & 3 | Mass flow of Helium required to maintain 10.5% Oxygen concentration (lb/hour of flight) See notes 1 and 2. |
|---|---|---|
| 0 | 0.0 | 0.0 |
| 10 | 7.73 | 3.36 |
| 20 | 15.26 | 6.71 |
| 30 | 22.90 | 10.07 |
| 40 | 30.53 | 13.43 |
| 50 | 38.16 | 16.79 |
| 60 | 45.79 | 20.14 |
| 70 | 53.42 | 23.50 |
| 80 | 61.06 | 26.86 |
| 90 | 68.69 | 30.21 |
| 100 | 76.32 | 33.56 |

Note 1 Compartment pressure 14.7 psia, compartment temperature = 30° F. Outside ambient pressure 14.7 max differential pressure. This results in the highest agent weight.
Note 2 Helium specific volume = 89.37 $ft^3$/lb at 30° F.
Note 3 Halon 1301 specific volume = 2.3585 $ft^3$/lb at 30° F.

For example, the weight of Helium required to maintain Oxygen concentration in the hazard approximately 10.50% Oxygen concentration (less than generally accepted concentration for fire suppression of around 12%) is 6.71 lb with a compartmental leakage rate of 20 cfm (typical leakage for a 1000 cubic feet volume cargo compartment). For a compartmental leakage rate of 20 cfm, 15.26 lb/hr of Halon 1301 is needed. Thus, less than half the weight of Halon 1301 is needed using Helium to achieve the same fire suppression capability. It will be appreciated by one experienced in the art of fire suppression in aircraft that Helium provides a significant mass advantage over Halon 1301.

Other advantages for using Helium is that Helium is readily obtained from natural gas and oil well sources, and is environmentally friendly as it poses no risk to reducing atmospheric ozone. However, as discussed below, halogenated derivatives of methane, such as without limitation Bromotrifluoromethane, or any other gaseous fire suppressant such as inert gases can also be used in various embodiments of the invention.

A first embodiment of the present invention is applied to fires in storage enclosures or cargo compartments. By way of overview, the first embodiment of the invention is a total flood fire suppression system that uses a two-bottle or two-tank system, where the first bottle or tank is dedicated to rapidly deliver a free efflux flooding of Helium or Helium blended with inert gases (such as Argon, Nitrogen, and Carbon Dioxide) to the storage spaces for suppressing the fire, and the second bottle is dedicated to deliver Helium gas compositions or Helium blended with inert gases (such as Argon, Nitrogen, and Carbon Dioxide) to the storage spaces at a rate sufficient to maintain fire suppressed. The free efflux flooding of Helium gas, or Helium gas blends, rapidly dilutes ambient Oxygen in the storage enclosure or compartment to establish a depleted Oxygen concentration that establishes suppression of the fire by reducing the intensity of the fire, or, depending on environmental conditions, may substantially disable the combustion process and extinguish the fire. Thereafter, Helium or Helium gas blend is delivered from the second bottle or tank to the storage enclosure or compartment at a rate sufficient to maintain the Oxygen concentration in the space at levels that keep the fire suppressed or, depending on environmental conditions, extinguish the fire. A non-limiting application of the first embodiment of the present invention is delivering Helium to at least one airplane compartment such as a cargo compartment.

FIG. 1A shows a total fire suppression system 10 for a space such as an airplane cargo compartment. The fire suppression system 10 preferably utilizes a fire suppressant containing a Helium composition that is stored in a plurality of storage bottles or reservoirs. The plurality of storage bottles includes a first bottle 12 and a second bottle 22. Given by way of non-limiting example, in one embodiment the first bottle 12 and the second bottle 22 each contain approximately 4.7 cubic feet pressurized Helium or Helium compositions to approximately 4500 psig in a spherical bottle the maximum outer diameter (OD) at zero pressure equal to approximately 26.125 inch. The first bottle 12 and the second bottle 22 each weigh approximately 77.5 lb when filled with Helium and deliver approximately 1453 $ft^3$ of Helium at standard temperature and pressure (STP) conditions. This gas volume will reduce Oxygen concentration to approximately 10.5% in a space of about 2000 $ft^3$ volume. This gas volume, from the second bottle, also maintains the oxygen concentration at approximately 10.5% in a 2000 $ft^3$ volume compartment for approximately 75 minutes if the compartment leakage rate is 40 cubic feet per minute. It will be appreciated that 10.5% oxygen concentration is substantially lower than the oxygen concentration generally accepted as necessary for fire suppression.

The first bottle 12 and the second bottle 22 suitably include ancillary equipment such as pressure gauges, pressure transmitters, refilling ports, refilling ductwork or gas delivery apparatus, lifting handles, and installation hardware (not shown). The first bottle 12 and the second bottle 22 are connected to a plurality of airplane compartments, such as a first compartment 40 and a second compartment 42. The first and second compartments 40 and 42 are suitably cargo compartments of an airplane. The Helium composition stored in the first bottle 12 is used to knock down a fire in either the first compartment 40 or the second compartment 42. Thereafter the Helium composition stored in the second bottle 22 is used to maintain suppression of a knocked-down fire in either of the first or second compartments 40 and 42.

First piping 36 pneumatically connects the first and second bottles 12 and 22 to the first compartment 40 via a first section 33, a second section 35, and a first discharge pipe 52 located inside the first compartment 40. The first discharge tube 52 may be positioned at any location in the first compartment 40. The first section 33 includes a first squib 14 attached to the first bottle 12 and a first venturi 18 downstream from the first squib 14. The second section 35 includes a second squib 24 attached to the second bottle 22, a second venturi 28 downstream from the second squib 24, and a first valve 32 downstream from the second venturi 28. The first valve 32 is a pressure-regulating valve that limits the pressure in the second section 35, downstream of the first valve 32, to a designed pressure that controls the continuous flow of Helium compositions from the second bottle 22 to the first compartment 40. The first and second squibs 14 and 24 release Helium from the first and second bottles 12 and 22. The first venturi 18 reduces the flow of Helium to a first flow rate and Helium pressure in the first section 33. The second venturi 28 reduces the flow of Helium to a second flow rate that is substantially less than the first flow rate and Helium pressure in the second section 35. The first flow rate may be on the order of thousands of cubic feet per minute to rapidly reduce the oxygen concentration in the compartment and quickly knock down the fire. The second flow rate may be on the order of tens of cubic feet per minute (approximately half the estimated total compartment leakage) to maintain the depleted oxygen concentration in the cargo compartment and the fire suppressed. The first venturi 18 and the second venturi 28 include any orifice, restrictor, or similarly-functioning flow restriction device.

Second piping 38 pneumatically connects the first and second bottles 12 and 22 to the second compartment 42 via a third section 37, a fourth section 39, and a second discharge tube 54 located inside the second compartment 42. The second discharge tube 54 may be positioned at any location in the second compartment 42. The third section 37 includes a third squib 16 attached to the first bottle 12 and a third venturi 20 downstream from the third squib 16. The fourth section 39 includes a fourth squib 26 attached to the second bottle 22, a fourth venturi 30 downstream from the fourth squib 26, and a second valve 34 downstream from the fourth venturi 30. The third and fourth squibs 16 and 26 release Helium from the first and second bottles 12 and 22. The third venturi 20 reduces the flow of Helium to a first flow rate and Helium pressure in the third section 37. The fourth venturi 30 reduces the flow of Helium and Helium pressure in the fourth section 39. The second valve 34 is a pressure-regulating valve that limits the pressure in the third section 37, downstream of the second valve 34, to a designed pressure that controls the continuous flow of Helium compositions from the second bottle 22 to the first compartment 42.

An arming switch 60 is electrically connected to a discharge switch 62 that is, in turn, electrically connected to the first squib 14. The arming switch 60, when depressed, provides electrical power to the discharge switch 62. An indicator 58 is electrically connected to the arming switch 60 and illuminates when the arming switch 60 is depressed, thus indicating to an operator that the first squib 14 has been successfully armed. The discharge switch 62, when depressed, provides electrical power to the first squib 14. This causes the first squib 14 to discharge, thus permitting the Helium to flow from the first bottle 12.

An indicator 64 is electrically connected to the first squib 14. When the first squib 14 is energized, electrical power is supplied to the indicator 64. This indicates to an operator that the first bottle 12 has discharged. The indicator 64 is also electrically connected to a pressure transducer (not shown) in the first bottle 12. The indicator 64 extinguishes when pressure in the first bottle 12 falls below a selected pressure threshold, thereby indicating the first bottle 12 has emptied.

According to the invention, the first compartment 40 and the second compartment 42 incorporate first and second discharge openings 48 and 50, respectively. The discharge openings 48 and 50 are suitably any acceptable device that can be open and shut, shown without limitation in aperture or plurality of apertures in a range of apertures, guide vanes, a flapper valve, a butterfly valve, or the like. The discharge openings 48 and 50 selectively open and shut, as discussed in detail below, to permit discharge of ambient air (mixed with some helium agent) from the first and second compartments 40 and 42, respectively. This permits the Helium to replace the ambient air, thus lowering the Oxygen concentration to a level that is unable to support combustion. Advantageously, this feature also prevents over pressurizing the first and second compartments 40 and 42 when large volumes of Helium are rapidly introduced into the first and second compartments 40 and 42.

A first actuator 44 is pneumatically connected to the second section 35 via piping 43 and a second actuator 46 is pneumatically connected to the third section 37 via piping 45. The first and second actuators 44 and 46 are arranged to control opening and shutting of the first and second discharge openings 48 and 50, respectively, in response to pressure in the second and third sections and 37, respectively. The first and second actuators 44 and 46 suitably include any acceptable actuator that translates pressure to a control signal or control motion. For example, in one embodiment the actuators 44 and 46 each include a piston (not shown) and a spring (not shown) that open and shut the first and second discharge opening 48 and 50 responsive to pressure sensed in the second and third sections 35 and 37, respectively. Alternatively, the actuators 44 and 46 suitably include a pressure-sensing transducer that generates an electrical control signal that controls a motor that opens and shuts the discharge openings 48 and 50.

A timer 56 is electrically connected to the first squib 14 and the third squib 24. When the first squib 14 is energized, the timer 56 is activated and the timer 56 begins counting for a predetermined time period that varies according to aircraft. The timer 56 is electrically connected to the second squib 24. After the timer 56 has counted for the predetermined time period the timer 56 automatically activates the discharge switch 62. This causes electrical power to be supplied from the discharge switch 62 to the second squib 24, causing the second squib 24 to discharge and thereby permitting the Helium to flow from the second bottle 22.

An arming indicator 57, an arming switch 59, the discharge indicator 64, and the third and fourth squibs 16 and 26 are provided along with the second actuator 46 and second discharge opening 50 to extinguish a fire in the second compartment 42. The indicator 57, arming switch 60, discharge switch 62, indicator 64, third and fourth squibs 16 and 26, timer 56, second actuator 46 and second discharge opening 50 are interconnected as described above for similar components and operate in the same manner as described above for extinguishing a fire in the first compartment 40. Accordingly, further detailed description of the construction and operation is not necessary for an understanding of the invention.

Oxygen depletion to suppress compartment fire is accomplished by Helium free efflux flooding method to knock down compartment fire and by a Helium metered flow method to keep the fire suppressed after being first knocked-down. The free efflux flooding with Helium method uses Helium from the first bottle 12 and the Helium metered flow method uses Helium from the second bottle 22.

Each of the first and second compartments 40 and 42 suitably has a fire detection system (not shown). In the event of a fire occurring in either the first compartment 40 or the second compartment 42, the present invention delivers Helium from the first bottle 12 in a rapid manner using the Helium free efflux flooding method and delivers Helium from the second bottle 22 in a continuous manner using the Helium metered flow method to the first compartment 40 or the second compartment 42.

The system 10 employs the Helium free efflux flooding method as follows. The following discussion explains suppression of fire in the first compartment 40 as a non-limiting example. It will be appreciated that fire in the second compartment 42 is suppressed in the same manner and need not be explained for an understanding of the invention. Fire warning signals are sent by the fire detection system (not shown) inside the first compartment 40. On fire warning the user initiates the fire suppression process by arming the squibs 14 and 24 for the compartment 40 by depressing the arming switch 60. Upon seeing the indicator 58 lit, that confirms that the first squib 14 is successfully armed, the user depresses the discharge switch 62. Pressing the discharge switch 62 causes the first squib 14 to fire and allow the Helium compositions to flow out rapidly from the first bottle 12. Also, pressing the discharge switch 62 causes the timer 56 to start. After a first time delay, the discharge switch 62 automatically fires the second squib 24, thereby readying the system 10 for subsequent engagement of the Helium metered flow method. The Helium composition flows from the first bottle 12 and the second bottle 22 to the first compartment 40 via the first piping 36 and the first discharge tube 53.

Before the first squib 14 is activated to fire by the discharge switch 62 and the second squib 24 is activated to fire by the timer 56, the first discharge opening 48 is closed. In concert with the pressure in the second section 35, the first actuator 44 selects apertures among a first range of variable apertures included in the first discharge opening 48 and thus allows the overboard flow of compartment ambient air (mixed with some Helium). Helium rapidly discharges into the first compartment 40 through the first discharge tube 52 and simultaneously ambient air (mixed with some Helium) discharges overboard from the compartment 40 through the first discharge opening 48. This causes free efflux flooding of the compartment 40 by the Helium compositions while rapidly reducing the Oxygen concentration in the compartment 40 to the design suppression concentration (typically below 12% is generally accepted as adequate for fire suppression).

Figure 1B:
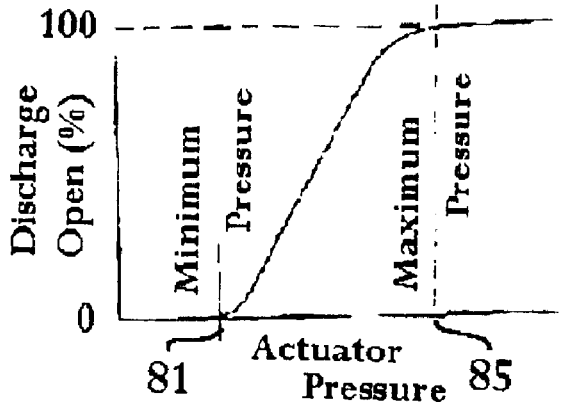
FIG. 1B is a pressure set-point graph depicting the minimum pressure and maximum pressure that activates actuators to control cargo compartment discharge opening apertures.

A pressure set-point graph shown in FIG. 1B illustrates how the first actuator 44 selects apertures among the first range of variable apertures in the first discharge opening 48. The pressure set-point graph illustrates the first range of apertures as a discharge open percentage (Discharge Open %). The first pressure set point has a minimum pressure 81 and the second pressure set point is maximum pressure 85. The discharge open percentage varies from fully closed (Discharge Open %=0%) when the first pressure set point 81 is set to the minimum pressure, to fully open (Discharge Open %=100%) when the second set point 85 is set to the maximum pressure. Pressure increases in the second section 35 as Helium is delivered from the first bottle 12. When the pressure increases in the second section 35 above the minimum pressure 81 but lower than maximum pressure 85, an intermediate aperture in the first discharge opening 48 is opened by the first actuator 44.

Thus, the first discharge opening is normally closed and starts to open when the pressure in the first actuator 44, transmitted by the second section 35, increases above the minimum pressure 81. The first discharge opening 48 is fully open when the first actuator 44 pressure is equal or greater than the maximum pressure 85.

The system 10 employs the metered flow method for delivering a continuous supply of Helium for maintaining suppressed a knocked-down fire as follows. The timer automatically causes the discharge switch 62 to fire the squib 24 on the bottle 22 after elapse of the predetermined time period. Alternatively, the user presses the discharge switch 62, after a predetermined time in the event the user chooses to operate the system manually causing the second squib 24 to fire. The firing of the second squib 24 causes Helium to flow from the second bottle 22 through the second venturi 28 and through the first pressure regulating valve 32 that is normally open. The pressure regulating valve 32 automatically controls the Helium pressure in the second section 35 to the designed value by throttling the upstream pressure. The pressure transducer (not shown) in the second bottle 22 detects the sudden change of pressure in the second bottle 22 and illuminates the discharge indicator 64. The illuminated discharge indicator 64 confirms the continuous flow of Helium compositions are being delivered from the second bottle 22 to the first compartment 40, such that the Oxygen concentration remains reduced inside the first compartment 40, thereby keeping the fire suppressed.

It will be appreciated by those experienced in the art that the invention utilizes "free efflux" flooding to quickly knockdown the fire. During free efflux flooding ambient air in the compartment is allowed to be displaced by the incoming Helium suppressant. The ambient air (mixed with some helium) is exhausted overboard through the variable discharge openings 48 and 50 in the compartments 40 and 42, respectively. The replacement of outflowing compartment air with inflowing Helium suppressant maintains the compartment at low and approximately constant pressure and prevents damage to the compartment structure.

It will be appreciated that other fire suppressant agents besides Helium may be used in the system 10. For example, halogenated derivatives of methane, such as without limitation Bromotrifluoromethane, or any other gaseous fire suppressant such as inert gases can also be used as desired in the system 10.

A second embodiment of the invention suppresses fires primarily involving combustible fluids and similarly uses the total flood fire suppression system having the two-bottle system, but differs in how the second bottle is used. By way of overview and like the first embodiment of the invention, ambient Oxygen in the space is rapidly depleted to levels unable to sustain combustion using rapid Helium flow or flood delivered by the first bottle. However, should the initially suppressed fire flare up again, or the fire not be sufficiently suppressed using the first bottle, then a secondary Helium flow or flood is delivered to the space using the second bottle. The second embodiment of the invention does not use the actuators and discharge openings to facilitate overboard discharge of ambient compartment air and is useful in suppression of fire in compartments that are normally ventilated.

An application of the second embodiment of the invention delivers Helium to at least one engine nacelle from the first bottle. Should the engine nacelle fire be extinguished but then flare up (re-ignition by hot surfaces), or if the engine nacelle fire be not sufficiently extinguished with Helium from the first bottle, then the secondary Helium flow or flood is delivered to the engine nacelle from the second bottle.

Figure 2:
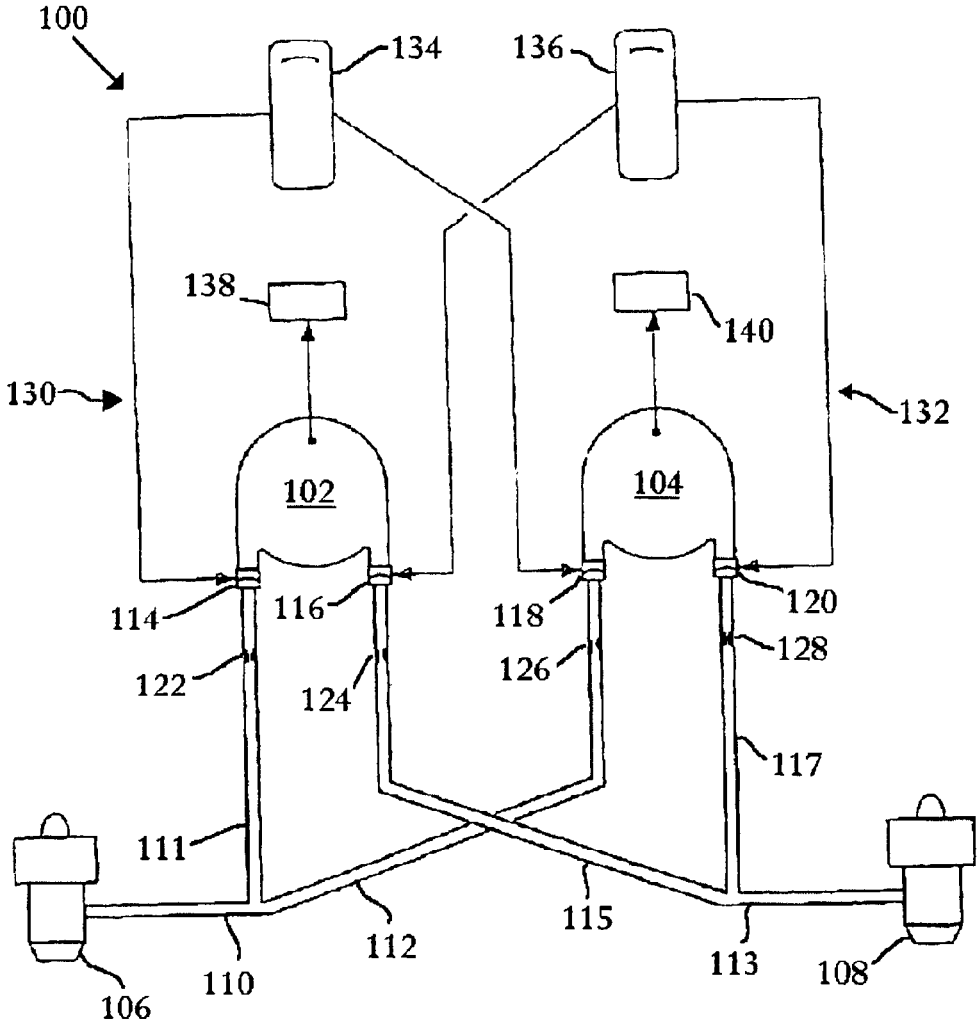
FIG. 2 is a schematic diagram of a Helium gas total flood fire suppression system for airplane engines.

FIG. 2 shows a Helium total fire suppression system 100 for a plurality of airplane engine nacelles. The engine nacelles may be wing mounted, fuselage mounted, or wing and fuselage mounted. Each engine nacelle has a fire detection system (not shown). According to the present invention, the system 100 utilizes a fire suppressant containing a Helium composition, and is stored in a plurality of storage bottles or reservoirs such as a first bottle 102 and a second bottle 104. The first bottle 102 and the second bottle 104 are comparably constructed as the first and the second bottles 12 and 22 of system 10 (FIG. 1A). The first bottle 102 and the second bottle 104 each have ancillary equipment such as pressure gauges, pressure transmitters, refilling ports, refilling ductwork or gas delivery apparatus, lifting handles, and installation hardware (not shown).

First piping 110 pneumatically connects the first and second bottles 102 and 104 to the first engine nacelle 106 via a first section 111 and a second section 112. The first section 111 includes a first squib 114 attached to the first bottle 102 and a first venturi 122 downstream from the first squib 114. The second section 112 includes a second squib 118 attached to the second bottle 104, and a second venturi 126 downstream from the second squib 118. The first and second squibs 114 and 118 release Helium from the first and second bottles 102 and 104. The first venturi 122 reduces the flow of Helium in the first section 111. The second venturi 126 reduces the flow of Helium in the second section 112.

Second piping 113 pneumatically connects the first and second bottles 102 and 104 to a second engine nacelle 108 via a third section 115 and a fourth section 117. The third section 115 includes a third squib 116 attached to the first bottle 102 and a third venturi 124 downstream from the third squib 116. The fourth section 117 includes a fourth squib 120 attached to the second bottle 104 and a fourth venturi 128 downstream from the fourth squib 120. The third and fourth squibs 116 and 120 release Helium from the first and second bottles 102 and 104. The third venturi 124 reduces the flow of Helium in the third section 115. The fourth venturi 128 reduces the flow of Helium in the fourth section 117.

The first and second squibs 114 and 118 are electrically connected to a first discharge switch 134 that has a first position and a second position. The second and third squibs 116 and 120 are electrically connected to a second discharge switch 136 that has a first position and a second position. The first position of the first discharge switch 134 activates the first squib 114 to release Helium from the first bottle 102. The second position of the first discharge switch 134 activates the second squib 118 attached to the second bottle 104 to release Helium from the second bottle 104. The first position of the second discharge switch 136 activates the third squib 116 to release Helium from the first bottle 102. The second position of the second discharge switch 136 activates the fourth squib 120 attached to the second bottle 104 to release Helium from the second bottle 104.

The first engine nacelle 106 suitably has a first fire detection circuit (not shown) and a first engine fire warning annunciator (not shown). The second engine nacelle 108 suitably has a second fire detection circuit (not shown) and a second engine nacelle fire warning annunciator (not shown).

The need to suppress a fire in the first engine nacelle 106 is determined by activation of the first engine fire warning annunciator. Upon fire annunciation in first engine nacelle 106, the user closes the thrust reverser lever of the first engine and shuts off fuel to the engine by engagement of a fuel control switch (not shown) to a cutoff position. The first squib 114 is activated by the first discharge switch 134 being placed in the first position by the user for a short duration (such as approximately one second). Helium is then discharged from the first bottle 102 through the first squib 114, passes through the first venturi 122, and is reduced in flow rate and pressure inside the first section 111. From the first section 111, the Helium is delivered via the first piping 110 to the first engine nacelle 106 as a first knockdown flow or flood. The first knockdown flow or flood of Helium continues until the first bottle 102 empties its contents. The sudden drop in pressure in the first bottle 102 on squib discharge is detected by a pressure transducer (not shown) mounted on the first bottle 102. The transducer causes a first discharge light 138 to illuminate and stay illuminated until the first bottle 102 is empty. This confirms successful discharge of the first bottle 102. Should the fire persist as indicated by continued annunciation by the first engine fire warning annunciator for longer than a predetermined time, a second knockdown Helium flow or flood is delivered from the second bottle 104 to the first engine nacelle 106 by the first discharge switch 134 being placed into the second position by the user for a short duration (approximately one second). This activates the second squib 118 attached to the second bottle 104. Helium is then discharged from the second bottle 104 through the second squib 118, passes through the second venturi 126, and is reduced in flow rate and pressure inside the second section 112. From the second section 112, the Helium is delivered via the first piping 110 to the first engine nacelle 106 as a second knockdown flow or flood. The second knockdown flow or flood of Helium continues until the second bottle empties its contents. The sudden drop in pressure in the bottle 104 on squib discharge is detected by a pressure transducer (not shown) mounted on the second bottle 104. The transducer causes a discharge light 140 to illuminate and stay illuminated until the bottle 104 is empty. This confirms successful discharge of the second bottle 104.

Knocking down a fire in the second engine nacelle 108 is performed in the same manner as described above. For a fire in the second engine nacelle 108, the second discharge switch 136 is operated by the user in the manner described above to discharge the third and fourth squibs 116 and 120 in the manner described above. Further description of knocking down a fire in the second engine nacelle 108 is not necessary for an understanding of the invention.

A third embodiment of the invention is an integration of the features of the first and second embodiments of the invention to suppress a fire either in a cargo compartment or in an engine nacelle using the same Helium reservoirs. By way of overview and in the event of a fire in the cargo compartment, the cargo compartment enclosure is provided a rapid flow of Helium from a first bottle, followed after a designed time delay by metered Helium delivered as a continuous flow as determined by a pressure regulating valve. For a flammable fluid fire, such as that may occur in an engine nacelle, the fuel source is first isolated from the fire by shutting off the fuel flow and then the nacelle enclosure is rapidly flooded with Helium from the first bottle to reduce the Oxygen concentration in the nacelle to suppress the fire. Should suppression fail or the fire subsequently flare up, the nacelle enclosure is rapidly flooded with Helium from a second bottle.

An application of the third embodiment of the invention is an airplane with at least one cargo compartment and at least one engine nacelle. Fire occurring in a cargo compartment is extinguished with the knockdown flow of Helium delivered from the first bottle, followed by continuous flow of Helium delivered by the second bottle. Flammable fluid fire occurring in the engine nacelle is extinguished by first isolating the engine from its fuel source, then rapidly delivering Helium from the first bottle to suppress the engine nacelle fire and, if needed, rapidly delivering Helium from the second bottle to extinguish the engine nacelle fire.

Figure 3A:
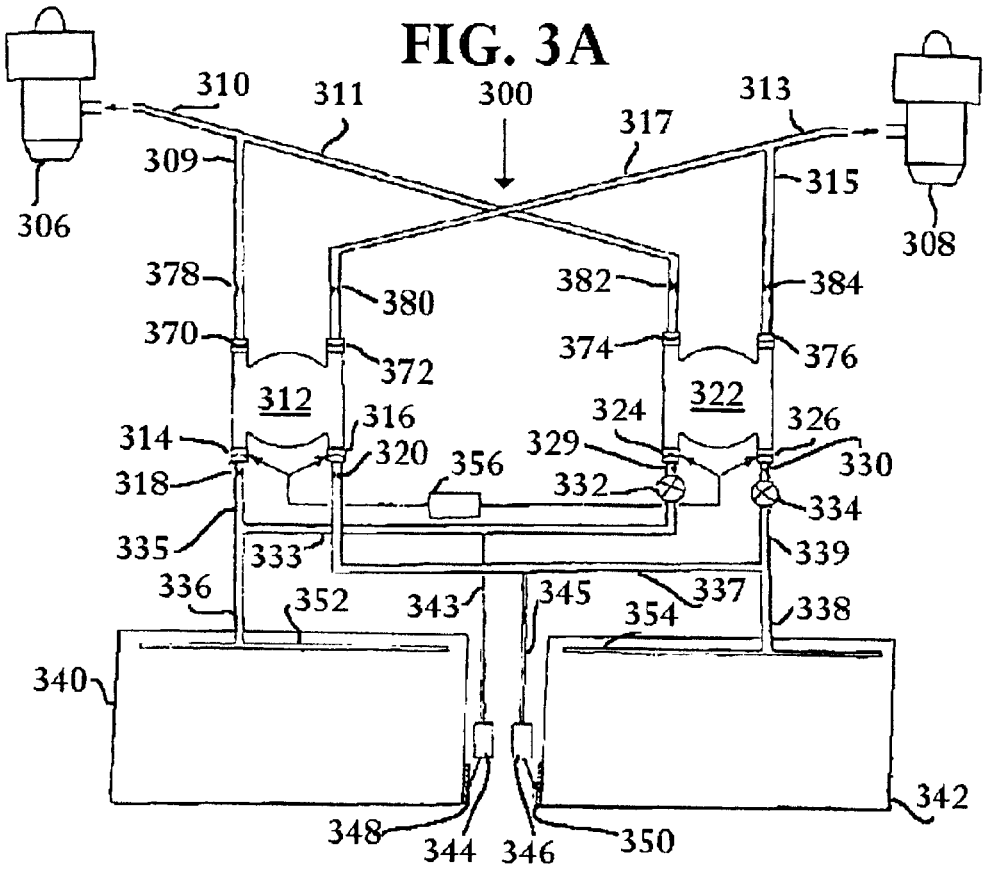
FIG. 3A is a schematic diagram of an integrated Helium gas total flood fire suppression system for airplane cargo compartments and engines.

FIG. 3A shows an integrated Helium total fire suppression system 300 for airplane engines and compartments. The system 300 includes a compartment subsystem and an engine subsystem that include features of the cargo compartment system 10 (FIG. 1A) and the engine suppression system 100 (FIG. 2), using Helium or Helium blended with inert gases. The system 300 has fire warning systems (not shown) for the cargo compartments and engine nacelles. The fire warning system includes annunciators such as lights, noise alarms, or vibration-generating devices.

The compartment subsystem includes a fire suppressant containing Helium compositions that is stored in a first bottle 312 and a second bottle 322. The first and second bottles 312 and 322 are similarly constructed as the first and second bottles 12 and 22 of system 10 (FIG. 1A). The first and second bottles 312 and 322 have ancillary equipment such as pressure gauges, pressure transmitters, refilling ports, lifting handles, and installation hardware (not shown).

The first bottle 312 is used to knock down fire in a plurality of cargo compartments, such as a first compartment 340 and a second cargo compartment 342. The first compartment 340 has a first fire detection system (not shown) and the second compartment 342 has a second fire detection system (not shown).

The Helium composition from the first bottle 312 is delivered to the first compartment 340 via first piping 336. The first piping 336 pneumatically connects the first bottle 312 to the first compartment 340 via a first section 335 and a first discharge tube 352 located inside the first compartment 340. The Helium composition from the second bottle 322 is delivered to the first compartment 340 via a second section 333 and the second discharge tube 352. A first squib 314, attached to the first bottle 312, is attached to the first section 335. Inside the first section 335 is a first venturi 318 downstream from the first squib 314. The first venturi 318 reduces the Helium flow inside the first section 335. A second squib 324, attached to the second bottle 322, is attached to the second section 333. Inside the second section 333 is a second venturi 329 downstream from the second squib 324 and a first valve 332 downstream from the second venturi 329. The second venturi 329 reduces the Helium flow inside the second section 333. A timer 356 is electrically connected to the spuibs 314, 316, 324, and 326 and operates as discussed above for the system 10 (FIG. 1A).

A first actuator 344, that is Pneumatically connected to the second section 333 via piping 343, and a first discharge opening 348 are located preferably at the bottom of the first compartment 340. Construction and operation of the first discharge opening 348 and the first actuator 344 are the same as set forth above for the discharge opening and actuators for the system 10 (FIG. 1A). Fire occurring in the first compartment 340 is suppressed using the Helium free efflux flooding flow and Helium metered flow methods described for the system 10 (FIG. 1A).

The Helium composition from the first bottle 312 is delivered to the second compartment 342 via second piping 338. The second piping 338 pneumatically connects the first bottle 312 to the second compartment 342 via a third section 337 and a second discharge tube 354 located inside the second compartment 342. The Helium composition from the second bottle 322 is delivered to the second compartment 342 via a fourth section 339 and the second discharge tube 354. A third squib 316, attached to the first bottle 312, is attached to the third section 337. Inside the third section 337 is a third venturi 320 downstream from the third squib 316. The third venturi 320 reduces the Helium flow inside the third section 337. A fourth squib 326, attached to the second bottle 322, is attached to the fourth section 339. Inside the fourth section 339 is a fourth venturi 330 downstream from the fourth squib 326 and a second valve 334 downstream from the fourth venturi 330. The fourth venturi 330 and the second valve 334 reduce the Helium flow inside the fourth section 339.

A second actuator 346, that is pneumatically connected to the third section 337 via piping 345, and a second discharge opening 350 are located preferably at the bottom of the second compartment 342. Construction and operation of the discharge opening 350 and the second actuator 346 are the same as set forth above for the discharge openings and actuators for the system 10 (FIG. 1A). Fire occurring in the second compartment 342 is extinguished using the Helium pressure flow and Helium metered flow methods described for the system 10 (FIG. 1A).

The engine subsystem of the system 300 also includes the first bottle 312 and the second bottle 322. The system 300 delivers a primary knockdown Helium flood and a secondary knockdown Helium flood to fires located inside a plurality of aircraft engine nacelles such as a first engine nacelle 306 and a second engine nacelle 308. The first engine nacelle 306 has a third fire detection system (not shown) and the second engine nacelle 308 has a fourth fire detection system (not shown). Third piping 310 pneumatically connects the first bottle 312 to the first engine nacelle 306 via a fifth section 309. The fifth section 309 connects to the first bottle 312 via a fifth squib 370. Downstream from the fifth squib 370 is a fifth venturi 378 that lowers Helium flow and Helium pressure in the fifth section 309.

The third piping 310 pneumatically connects the second bottle 322 to the first engine nacelle 306 via a sixth section 311. The sixth section 311 connects to the second bottle 322 via a sixth squib 374. Downstream from the sixth squib 374 is a sixth venturi 382 that lowers Helium flow in the sixth section 311.

Fourth piping 313 pneumatically connects the first bottle 312 to the second engine nacelle 308 via a seventh section 317. The seventh section 317 connects to the first bottle 312 via a seventh squib 372. Downstream from the seventh squib 372 is a seventh venturi 380 that lowers Helium flow in the seventh section 317.

The fourth piping 313 pneumatically connects the second bottle 322 to the second engine nacelle 308 via an eighth section 315. The eighth section 315 connects to the second bottle 322 via an eighth squib 376. Downstream from the eighth squib 376 is an eighth venturi 384 that lowers Helium flow in the eighth section 315.

Fire occurring in either the first engine nacelle 306 or the second engine nacelle 308 is extinguished via the same methods described above for the system 100 (FIG. 2) using the same squib activation circuits (not shown) used in the system 100.

Although Helium compositions are the preferred fire suppressant utilized in the integrated system shown in FIG. 3A, it will be appreciated by those experienced in the art that other gaseous fire suppressants such as halocarbons, halogenated methane (Halon 1301), inert gases, etc., may also be used.

The bottles 312 and 322 of the system 300 contain the Helium compositions required to suppress the fire occurring in the cargo compartment or engine nacelle. Those experienced in the art will appreciate that this aspect of the invention results in use of fewer fire suppression agent bottles and lower mass of total fire suppressant carried on board the airplane. Also, this results in greater fire suppression capability for the non-critical fires. The non-critical fire is defined herein as the fire that requires lower quantity of fire suppression agent than that available on board. For typical commercial airplanes, the noncritical fire would be engine nacelle fire.

Figure 3B:
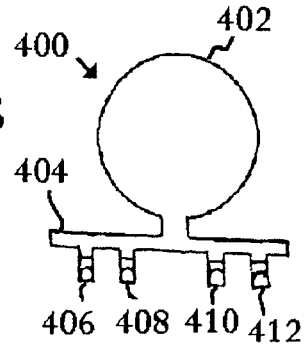
FIG. 3B is an alternate embodiment of the Helium reservoir in the integrated Helium gas total flood fire suppression system.

It will be appreciated that the number of Helium reservoirs of the present invention is not limited to the dual body reservoir system of the preferred embodiments. More than two reservoirs can be used, with each reservoir having a plurality of piping not limited to a dual piping set. Alternatively, FIG. 3B represents an alternate non-limiting example of the Helium reservoir or bottle used in the system 300. The Helium reservoir may be used to replace the first bottle 312 or the second bottle 322. A Helium reservoir 400 has a single manifold 404 attached to a single bottle 402. The single manifold 404 has a first squib 406, a second squib 408, a third squib 410, and a fourth squib 412. The piping sections 309, 317, 336 and 337 of the bottle 312 are connected to the single manifold 404 with the set of four squibs 406, 408, 410, and 412. Similarly, the piping sections 311, 315, 333 and 339 are connected to the single manifold 404 with the set of four squibs 406, 408, 410, and 412.

Figure 4:
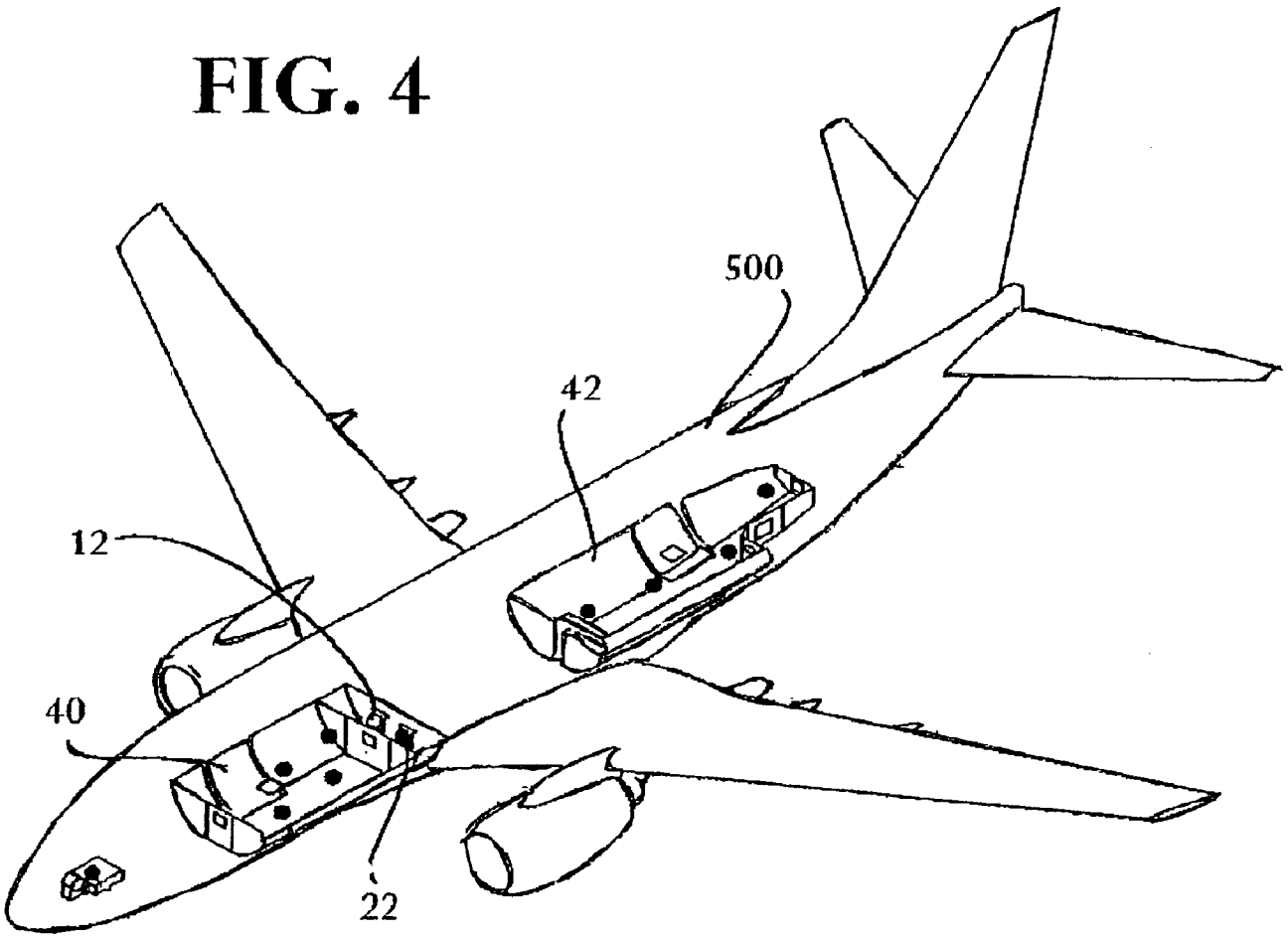
FIG. 4 is a partial cutaway, perspective view of airplane compartments incorporating the system of the present invention.

FIG. 4 is a partial cutaway, perspective view of airplane compartments incorporating the systems of the present invention arranged in an airplane 500. The first compartment 40 is located in a forward section of a fuselage and the second compartment 42 is located in an aft section of the fuselage of the airplane 500. The first bottle and the second bottle are located just aft of the first compartment 40. The pictorial representation of FIG. 4 represents one configuration given by way of non-limiting example. It will be appreciated that many alternative arrangements of the compartment configuration are possible.

Figure 5:
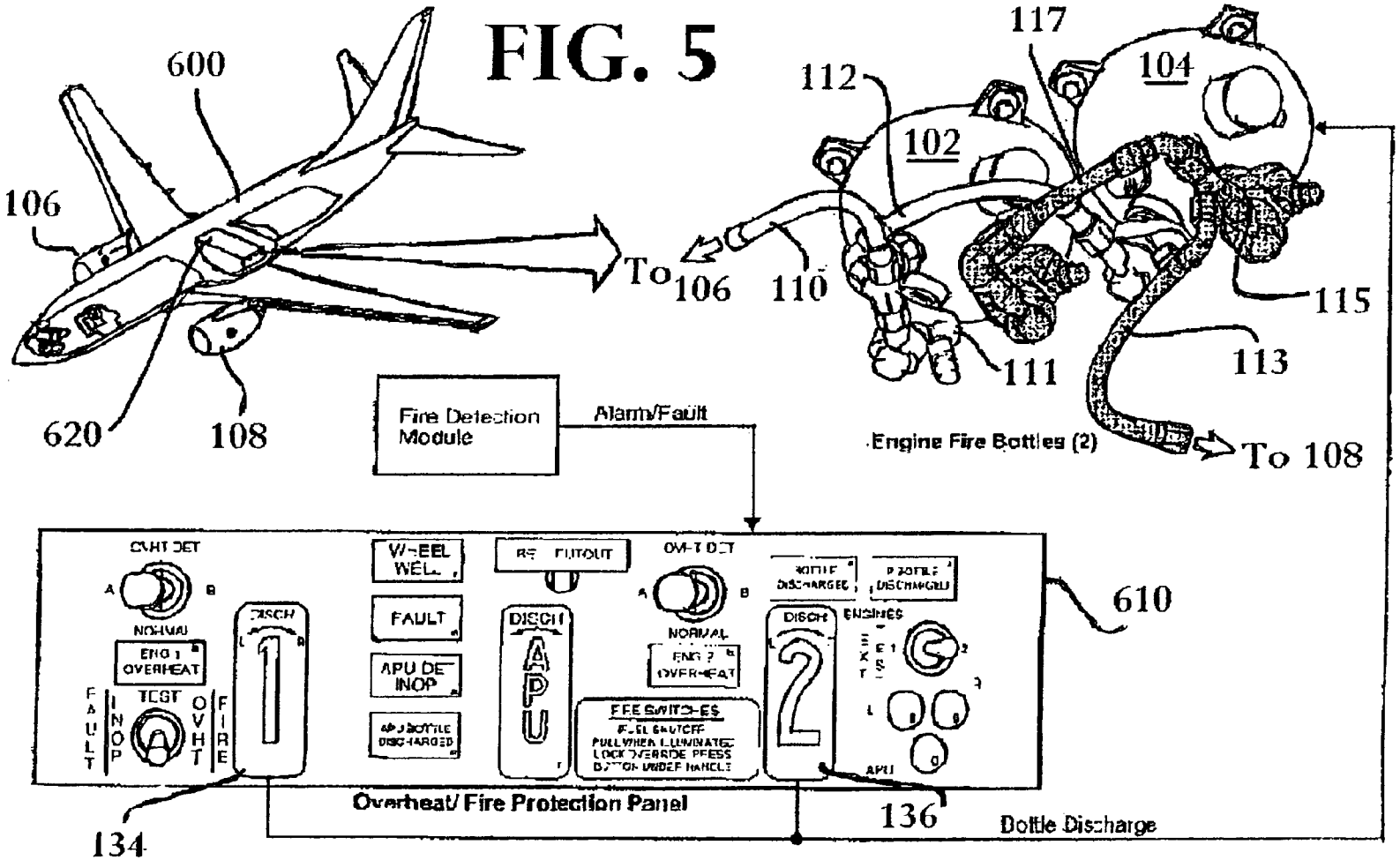
FIG. 5 shows a schematic and pictorial details of an engine nacelle configuration incorporating the system of the present invention.

FIG. 5 shows schematic and pictorial details of an engine nacelle configuration incorporating the system of the present invention arranged in an airplane 600. The first bottle 102, the first piping 110, the first section 111, the second section 112, the second bottle 104, the second piping 113, the third section 115, and the fourth section 117 are schematically and pictorially displayed in the airplane 600. The first discharge switch 134 and the second discharge switch 136 are shown as part of an instrument panel 610 located approximately at a center section of the airplane 600. The discharge switch 134 controls the delivery of Helium gas from the first bottle 102 and from the second bottle 104 to the first engine nacelle 106. The discharge switch 136 controls the delivery of Helium gas from the first bottle 102 and the second bottle 104 to the second engine nacelle 108. The first bottle 102 and the second bottle 104 are shown located approximately at a center section 620 of the airplane 600. The schematic and pictorial representation of FIG. 5 represents a single configuration example. It will be appreciated that many alternative arrangements of the engine nacelle configuration are possible.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

What is claimed is:

1. A fire suppression system comprising:

at least a first reservoir for storing a fire suppressant composition for knocking down fire in an enclosed space;

piping arranged to deliver the fire suppressant composition from the at least first reservoir to the enclosed space;

a pressure sensor arranged to sense pressure of the fire suppressant compositions in the piping; and a controllable purging device that permits air to exit the enclosed space responsive to sensed pressure in the piping of the fire suppressant composition.

2. The fire suppression system of claim 1, wherein the controllable purging device opens a normally shut exit defined in the enclosed space when sensed pressure in the piping of the fire suppressant composition is greater than a first predetermined threshold pressure.

3. The fire suppression system of claim 2, wherein the controllable purging device includes one of a flapper valve, a butterfly valve, and guide vanes.

4. The fire suppression system of claim 1, further comprising:

a second reservoir for storing the fire suppressant composition for suppressing the fire in the enclosed space, the piping being arranged to further deliver the fire suppressant composition from the second reservoir to the enclosed space; and a pressure regulating valve that maintains pressure in the piping from flow of the fire suppressant composition from the second reservoir below a second predetermined threshold pressure that is lower than the first predetermined threshold pressure.

5. The fire suppression system of claim 4, further comprising a first normally shut actuator that actuates to permit the fire suppressant compositions to flow from the first reservoir.

6. The fire suppression system of claim 5, further comprising:

a timer that begins timing when the first actuator is actuated; and a second actuator that actuates after the timer reaches a predetermined time to permit the fire suppressant compositions to flow from the second reservoir.

7. The fire suppression system of claim 4, further comprising:

a first orifice that is arranged to limit flow of the fire suppressant compositions from the first reservoir to a first flow rate; and a second orifice that is arranged to limit flow of the fire suppressant compositions from the second reservoir to a second flow rate that is less that the first flow rate.

8. The fire suppression system of claim 4, wherein the fire suppressant composition includes inert gases.

9. The fire suppression system of claim 8, wherein the inert gases include Helium.

10. The fire suppression system of claim 9, wherein the fire suppressant composition includes halogenated derivatives of methane.

11. The fire suppression system of claim 4, wherein the enclosed space includes a cargo compartment in an airplane.

12. A fire suppression system comprising:

first and second reservoirs for storing a fire suppressant composition;

enclosed space piping arranged to deliver a first flow of the fire suppressant composition from the first reservoir to an enclosed space at a first flaw rate, the enclosed space piping being further arranged to deliver a second flow of the fire suppressant composition from the second reservoir to the enclosed space at a second flow rate that is less than the first flow rate;

unenclosed space piping arranged to deliver the fire suppressant composition from the first and second reservoirs to an unenclosed second space;

a pressure sensor arranged to sense pressure in the enclosed space piping of the fire suppressant composition;

a controllable purging device that permits air to exit the enclosed space responsive to sensed pressure in the enclosed space piping of the fire suppressant composition; and first and second unenclosed space squibs that actuate to permit the fire suppressant composition to flow from the first and second reservoirs, respectively, to the unenclosed space responsive to first and second signals, respectively, that are selected by a user.

13. The fire suppression system of claim 12, wherein the controllable purging device opens a normally shut exit defined in the enclosed space when sensed pressure in the enclosed space piping of the fire suppressant composition is greater than a first predetermined threshold pressure.

14. The fire suppression system of claim 13, wherein the controllable purging device includes one of a flapper valve, a butterfly valve, and guide vanes.

15. The fire suppression system of claim 12, further comprising a pressure regulating valve that maintains pressure in the enclosed space piping from the second flow of the fire suppressant composition from the second reservoir below a second predetermined threshold pressure.

16. The fire suppression system of claim 12, further comprising a first enclosed space squib that actuates to permit the first flow of the fire suppressant composition to flow from the first reservoir to the enclosed space.

17. The fire suppression system of claim 16, further comprising:

a timer that begins timing when the first enclosed space squib is activated; and a second enclosed space squib that actuates after the timer reaches a predetermined time to permit the second flow of the fire suppressant composition to flow from the second reservoir to the enclosed space.

18. The fire suppression system of claim 12, wherein the fire suppressant composition includes inert gases.

19. The fire suppression system of claim 18, wherein the inert gases include Helium.

20. The fire suppression system of claim 12, wherein the fire suppressant composition includes halogenated derivatives of methane.

21. The fire suppression system of claim 12, wherein the enclosed space includes a cargo compartment in an airplane.

22. The fire suppression system of claim 12, wherein the unenclosed space includes a nacelle of an aircraft engine.

23. The fire suppression system of claim 12, further comprising:

a first orifice that is arranged to limit the first flow of the fire suppressant composition to the first flow rate; and a second orifice that is arranged to limit the second flow of the fire suppressant composition to the second flow rate.

24. A method for suppressing fire in an enclosed space, the method comprising:

delivering a first flow of a fire suppressant composition from a first reservoir through piping arranged to deliver the fire suppressant composition to an enclosed space to knock down fire in the enclosed space;

sensing pressure of the first flow of the fire suppressant composition in the piping; and controllably permitting air to exit the enclosed space when sensed pressure in the piping of the first flow of the fire suppressant composition is greater than a first predetermined threshold pressure.

25. The method of claim 24, further comprising:

timing when delivery of the first flow of the fire suppressant composition is actuated; and after a predetermined time period, delivering a second flow of the fire suppressant composition from a second reservoir through the piping to the enclosed space to maintain suppressed the fire in the enclosed space.

26. The method of claim 25, further comprising:

sensing pressure of the second flow of the fire suppressant composition; and regulating pressure of the second flow of the fire suppressant composition below a second predetermined threshold pressure.

27. An airplane comprising:

a fuselage with a cargo compartment; and a fire suppression system including:

at least a first reservoir for storing a fire suppressant composition for knocking down fire in the cargo compartment;

piping arranged to deliver the fire suppressant composition from the at least first reservoir to the cargo compartment;

a pressure sensor arranged to sense pressure of the fire suppressant composition in the piping; and a controllable purging device that permits air to exit the cargo compartment responsive to sensed pressure in the piping of the fire suppressant composition.

28. An airplane comprising:

a fuselage with a cargo compartment;

an engine with a nacelle; and a fire suppression system including:

first and second reservoirs for storing a fire suppressant composition;

cargo compartment piping arranged to deliver a first flow of the fire suppressant composition from the first reservoir to the cargo compartment at a first flow rate, the cargo compartment piping being further arranged to deliver a second flow of the fire suppressnt composition from the second reservoir to the cargo compartment at a second flow rate that is less than the first flow rate;

nacelle piping arranged to deliver the fire suppressant composition from the first and second reservoirs to the nacelle;

a pressure sensor arranged to sense pressure in the cargo compartment piping of the fire suppressant composition;

a controllable purging device that permits air to exit the cargo compartment responsive to sensed pressure in the cargo compartment piping of the fire suppressant composition; and first and second nacelle squibs that actuate to permit the fire suppressant composition to flow from the first and second reservoirs, respectively, to the nacelle responsive to first and second signals, respectively, that are selected by a user.

* * * * *